US008525765B2

(12) United States Patent
Kim et al.

(10) Patent No.: US 8,525,765 B2
(45) Date of Patent: Sep. 3, 2013

(54) DISPLAY DRIVER CIRCUIT AND DISPLAY DEVICE THAT OUTPUTS SYMMETRICAL GRAYSCALE VOLTAGES

(75) Inventors: In-Suk Kim, Suwon-si (KR); Jae-Goo Lee, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 552 days.

(21) Appl. No.: 12/766,508

(22) Filed: Apr. 23, 2010

(65) Prior Publication Data

US 2011/0032279 A1 Feb. 10, 2011

(30) Foreign Application Priority Data

Aug. 5, 2009 (KR) ..... 10-2009-0072092

(51) Int. Cl.
*G09G 3/36* (2006.01)

(52) U.S. Cl.
USPC ..... 345/89; 345/690

(58) Field of Classification Search
USPC ..... 345/89, 690
See application file for complete search history.

(56) References Cited

U.S. PATENT DOCUMENTS

| | | | | |
|---|---|---|---|---|
| 7,760,178 | B2 * | 7/2010 | Takada et al. | 345/89 |
| 2002/0158862 | A1 * | 10/2002 | Chen et al. | 345/211 |
| 2002/0186230 | A1 * | 12/2002 | Kudo et al. | 345/690 |
| 2004/0021627 | A1 * | 2/2004 | Maki | 345/89 |
| 2006/0071212 | A1 * | 4/2006 | Song et al. | 257/59 |
| 2007/0146395 | A1 * | 6/2007 | Lee | 345/690 |
| 2009/0015532 | A1 * | 1/2009 | Katayama et al. | 345/89 |
| 2010/0225678 | A1 * | 9/2010 | Kim et al. | 345/690 |

FOREIGN PATENT DOCUMENTS

| | | | |
|---|---|---|---|
| KR | 10-1999-0011349 | A | 2/1999 |
| KR | 10-2005-0015035 | A | 2/2005 |
| KR | 10-2008-0060433 | A | 7/2008 |

* cited by examiner

*Primary Examiner* — Kwang-Su Yang
(74) *Attorney, Agent, or Firm* — Sughrue Mion, PLLC

(57) ABSTRACT

A display driver circuit and a display device are provided. The display driver circuit may have positive and negative resistor strings that are symmetrically formed and include a plurality of resistors, and applies a gamma voltage to one of the positive and negative resistor strings in response to a polarity selection signal, thereby generating and outputting a positive grayscale voltage and a negative grayscale voltage.

19 Claims, 4 Drawing Sheets

DISPLAY DRIVER CIRCUIT AND DISPLAY DEVICE THAT OUTPUTS SYMMETRICAL GRAYSCALE VOLTAGES

PRIORITY STATEMENT

This application claims priority from Korean Patent Application No. 10-2009-0072092, filed on Aug. 5, 2009, the contents of which are hereby incorporated herein by reference in its entirety.

BACKGROUND

One or more exemplary embodiments relate to a display driver circuit and display device, and more particularly, to a display driver circuit outputting symmetrical grayscale voltages at high speed and low power consumption and a display device.

SUMMARY

One or more exemplary embodiments provide a display driver circuit that outputs symmetrical grayscale voltages at high speed and low power consumption.

According to an aspect of an exemplary embodiment, there is provided a display driver circuit, the display driver circuit including: a reference voltage selection unit configured to receive and divide first supply voltage and a second supply voltage, and select and output a maximum reference voltage and a minimum reference voltage; and a grayscale voltage generator including a gamma voltage selector configured to receive the maximum and minimum reference voltages, generate at least two gamma voltages by dividing the maximum and minimum reference voltages, and generate, using the at least two gamma voltages, at least two positive grayscale voltages that range from the minimum reference voltage to the maximum reference voltage or at least two negative grayscale voltages that range from the maximum reference voltage to the minimum reference voltage. Here, a difference between a first positive grayscale voltage and a second positive grayscale voltage of the at least two positive grayscale voltages equals to a difference between a first negative grayscale voltage and a second negative grayscale voltage of the at least two negative grayscale voltages.

The reference voltage selection unit may include: a first resistor string including a plurality of first resistors connected in series between the first and second supply voltages and configured to divide the first and second supply voltages; a maximum reference voltage selector configured to select a first voltage divided by the first resistor string in response to a maximum reference voltage selection signal, and output the first voltage as the maximum reference voltage; a minimum reference voltage selector configured to select a second voltage divided by the first resistor string that is lower than the maximum reference voltage in response to a minimum reference voltage selection signal, and output the second voltage as the minimum reference voltage; a first reference buffer configured to receive and buffer the maximum reference voltage, and output a maximum gamma voltage from among the at least two gamma voltages; and a second reference buffer configured to receive and buffer the minimum reference voltage, and output a minimum gamma voltage from among the at least two gamma voltages.

The gamma voltage selector may include: a gamma voltage generator configured to receive the maximum and minimum gamma voltages and generate the at least two gamma voltages by dividing the maximum and minimum gamma voltages in response to one or more gamma selection signals; a resistor selector configured to apply the at least two gamma voltages to the corresponding nodes among a plurality of nodes of a resistor string selected from a positive resistor string and a negative resistor string in response to a polarity selection signal; a resistor string unit including the positive resistor string and the negative resistor string that receive the at least two gamma voltages at the corresponding nodes, and respectively generate the at least two positive grayscale voltages having sequentially increasing levels and the at least two negative grayscale voltages having sequentially decreasing levels by dividing the at least two gamma voltages; and a grayscale voltage selector configured to receive the at least two positive grayscale voltages and the at least two negative grayscale voltages from the resistor string selected from the positive resistor string and the negative resistor string in response to the polarity selection signal, and output a selection grayscale voltage.

The gamma voltage generator may include a second resistor string including a plurality of second resistors connected in series between the maximum and minimum gamma voltages and configured to divide the maximum and minimum gamma voltages; and a gamma selection unit configured to select at least one gamma voltage divided by the second resistor string in response to the one or more gamma selection signals and output the at least one selected gamma voltage.

The positive resistor string may include a plurality of third resistors connected in series, and may be configured to receive the at least two gamma voltages and generate the at least two positive grayscale voltages by dividing the at least two gamma voltages.

The negative resistor string may include a plurality of fourth resistors having the same resistance as the third resistors, connected in series, and disposed in the reverse order of the third resistors, and may be configured to receive the at least two gamma voltages and generate the at least two negative grayscale voltages by dividing the at least two gamma voltages.

The resistor selector may include: a first polarity selector configured to apply the maximum gamma voltage to a first end of the resistor string selected from the positive resistor string and the negative resistor string, in response to the polarity selection signal; a second polarity selector configured to apply the minimum gamma voltage to a second end of the resistor string selected from the positive resistor string and the negative resistor string in response to the polarity selection signal; and a gamma selection buffer unit configured to receive at least two gamma voltages and output the at least two gamma voltages to corresponding nodes of the resistor string selected from the positive resistor sting and the negative resistor string in response to the polarity selection signal.

The grayscale voltage generator may further include a common voltage generator configured to generate and output at least one of a first common voltage that is lower than the minimum gamma voltage and a second common voltage that is higher than the maximum gamma voltage in response to the polarity selection signal.

The grayscale voltage generator may further include: a reference voltage selection register configured to output the maximum and minimum reference voltage selection signals; a gamma selection register configured to output the one or more gamma selection signals; and a polarity selection register configured to output the polarity selection signal in response to a polarity signal. The display driver circuit may further include: a controller configured to output a source driver control signal, a gate driver control signal, and the polarity signal in response to image data and a command; a source driver configured to receive the selection grayscale voltage in response to the source driver control signal, and apply a display data voltage to data lines of a display panel; and a gate driver configured to apply a gate-on voltage to gate lines of the display panel in response to the gate driver control signal.

BRIEF DESCRIPTION OF THE DRAWINGS

The above and/or other aspects will become apparent and more readily appreciated from the following description of exemplary embodiments, with reference to the accompanying drawings in which.

DETAILED DESCRIPTION OF THE EXEMPLARY EMBODIMENTS

Figure 1:
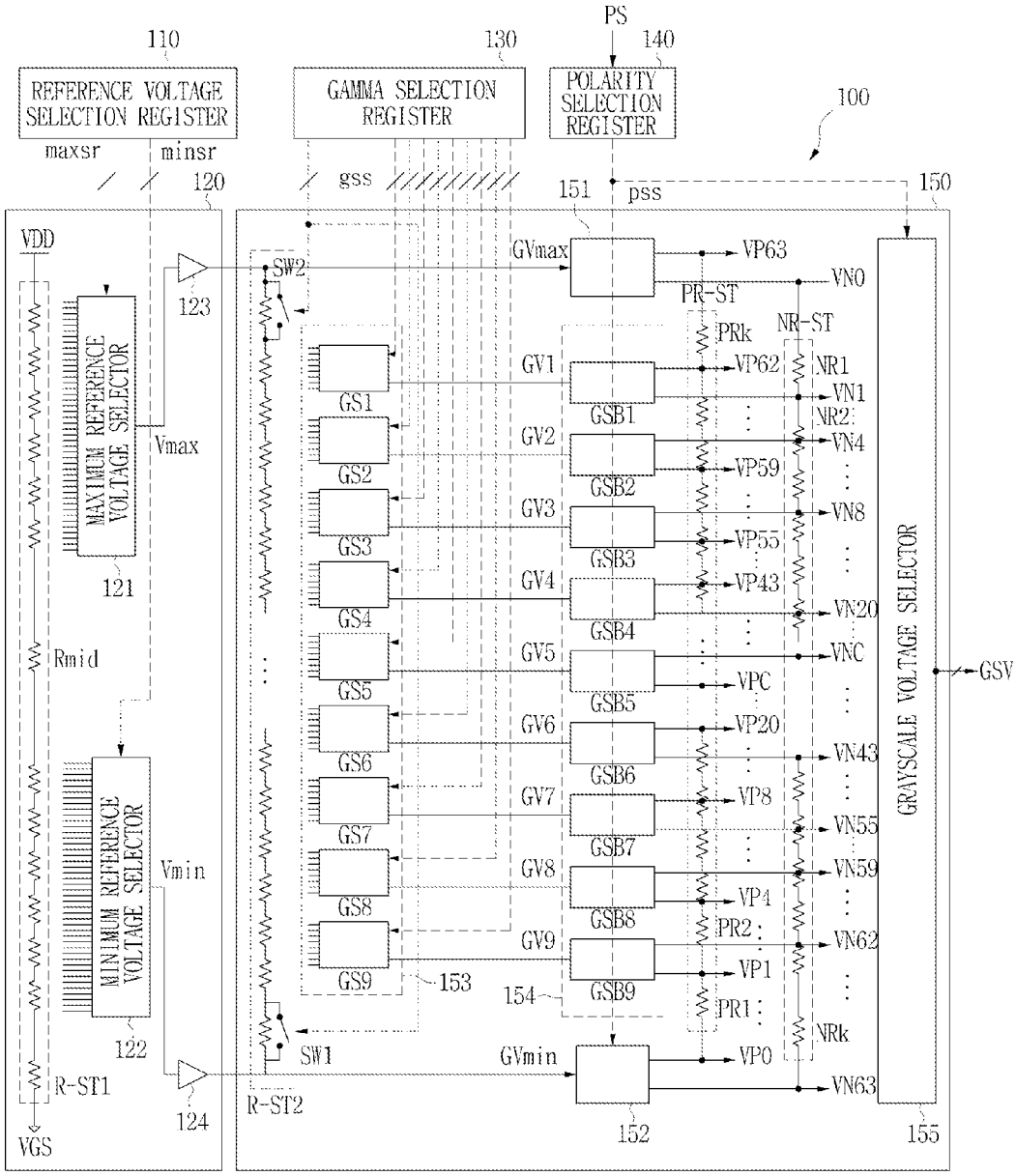
FIG. 1 illustrates a display driver circuit according to an exemplary embodiment.

Various exemplary embodiments will now be described more fully with reference to the accompanying drawings in which some example embodiments are shown. In the drawings, various aspects such as the thicknesses of layers and regions may be exaggerated for clarity. Detailed illustrative embodiments are disclosed herein. However, specific structural and functional details disclosed herein are merely representative for purposes of describing example embodiments. This inventive concept, however, may be embodied in many alternate forms and should not be construed as limited to only example embodiments set forth herein.

Among display devices, a liquid crystal display (LCD) includes a panel having a plurality of pixel units. Each pixel unit includes an array substrate on which a switching device and a pixel electrode are formed, a counter substrate facing the array substrate and on which a common electrode is formed, and a liquid crystal layer interposed between the array substrate and the counter substrate. Each pixel unit controls light transmissivity by applying an electric field to the liquid crystal layer, thereby displaying an image. To be specific, the transmissivity of the liquid crystal layer is controlled by a difference between voltages applied to the pixel electrode and the common electrode.

However, when an electric field in one direction is constantly applied to the liquid crystal layer by voltages applied to the common electrode and the pixel electrode, the liquid crystal layer deteriorates. In order to not fix an electric field applied to a liquid crystal layer in one direction and prevent such a deterioration of the liquid crystal layer, a display driver circuit driving the panel of a display device periodically inverts the polarity of each pixel electrode with respect to a common electrode. Grayscale voltages with two polarities applied to a pixel electrode are classified into a positive grayscale voltage and negative grayscale voltage. A display driver circuit inverts the polarity of a pixel electrode using dot inversion, line inversion, frame inversion, etc.

FIG. 1 illustrates a display driver circuit according to an exemplary embodiment.

In FIG. 1, a display driver circuit 100 includes a reference voltage selection register 110, a reference voltage selection unit 120, a gamma selection register 130, a polarity selection register 140, and a gamma voltage selector 150.

The reference voltage selection register 110 outputs a maximum reference voltage selection signal (maxsr) and a minimum reference voltage selection signal (minsr) to the reference voltage selection unit 120. The maximum reference voltage selection signal maxsr and the minimum reference voltage selection signal minsr may be stored in advance in a maximum reference voltage selection register and a minimum reference voltage selection register, respectively, or received from an external source.

The reference voltage selection unit 120 includes a first resistor string R-ST1, a maximum reference voltage selector 121, a minimum reference voltage selector 122, and first and second reference buffers 123 and 124.

The first resistor string R-ST1 has a plurality of resistors connected in series between a first supply voltage VDD and a second supply voltage VGS, and outputs a plurality of voltages that are between the first supply voltage VDD and the second supply voltage VGS.

The maximum reference voltage selector 121 selects and outputs a maximum reference voltage Vmax among the voltages output from the first resistor string R-ST1 in response to the maximum reference voltage selection signal maxsr output from the reference voltage selection register 110, and the minimum reference voltage selector 122 selects and outputs a minimum reference voltage Vmin among the voltages output from the first resistor string R-ST1 in response to the minimum reference voltage selection signal minsr output from the reference voltage selection register 110. At this time, the maximum reference voltage selector 121 selects a voltage output between a resistor Rmid disposed in the middle of the resistors of the first resistor string R-ST1 connected in series and the first supply voltage VDD and outputs the selected voltage as the maximum reference voltage Vmax. The minimum reference voltage selector 122 selects a voltage output between the resistor Rmid and the second supply voltage VGS and outputs the selected voltage as the minimum reference voltage Vmin. The maximum and minimum reference voltage selectors 121 and 122 may be implemented as multiplexers (MUXs) or decoders.

The first and second reference buffers 123 and 124 receive and buffer the maximum and minimum reference voltages Vmax and Vmin, and output maximum and minimum gamma voltages GVmax and GVmin, respectively.

The gamma selection register 130 outputs a plurality of gamma selection signals (gss). Like the maximum and minimum reference voltage selection signals maxsr and minsr, the gamma selection signals gss may be stored in the gamma selection register 130 in advance or received from an external source.

The polarity selection register 140 outputs a polarity selection signal (pss) in response to a polarity signal PS. The polarity signal PS may be received from a controller (not shown) of a display device, and is a control signal for controlling the display driver circuit 100 to accurately output positive and negative grayscale voltages at a predetermined time.

The gamma voltage selector 150 includes first and second polarity selectors 151 and 152, a second resistor string R-ST2, a gamma selection unit 153, a gamma buffer unit 154, positive and negative resistor strings PR-ST and NR-ST, and a grayscale voltage selector 155.

The first polarity selector 151 receives the maximum gamma voltage GVmax, and applies the maximum gamma voltage GVmax as a sixty-fourth positive grayscale voltage VP63 or a first negative grayscale voltage VN0 to one end of the positive resistor string PR-ST or the negative resistor string NR-ST, respectively, in response to the polarity selection signal pss applied from the polarity selection register 140. The second polarity selector 152 receives the minimum gamma voltage GVmin, and applies the minimum gamma voltage GVmin as a first positive grayscale voltage VP0 or a sixty-fourth negative grayscale voltage VN63 to the other end of the positive resistor string PR-ST or the negative resistor string NR-ST, respectively, in response to the polarity selection signal pss.

In one or more exemplary embodiments, it is assumed that the display driver circuit 100 outputs grayscale voltages with first and second polarities, and each of the grayscale voltages with first and second polarities are output as sixty-four grayscale voltages VP0 to VP63 or VN0 to VN63. Here, it is assumed that the first-polarity grayscale voltages are positive grayscale voltages, and the second-polarity grayscale voltages are negative grayscale voltages. Thus, the maximum reference voltage Vmax output from the reference voltage selection unit 120 is output as the sixty-fourth positive grayscale voltage VP63 and the first negative grayscale voltage VN0, and the minimum reference voltage Vmin is output as the first positive grayscale voltage VP0 and the sixty-fourth negative grayscale voltage VN63. However, the number of grayscale voltages output by the display driver circuit 100 may be adjusted. When the number of grayscale voltages output by the display driver circuit 100 is n (where n is a natural number larger than 2), the maximum voltage Vmax output from the first reference buffer 123 may be output as an nth positive grayscale voltage VPn−1 and the first negative grayscale voltage VN0, and the minimum voltage Vmin output from the second reference buffer 124 may be output as the first positive grayscale voltage VP0 and an nth negative grayscale voltage VNn−1.

The second resistor string R-ST2 has a plurality of resistors connected in series between the maximum and minimum gamma voltages GVmax and GVmin and two switches SW1 and SW2, and outputs a plurality of gamma voltages GV1 to GV9. The two switches SW1 and SW2 are connected in parallel with resistors disposed at both ends of the second resistor string R-ST2, and turned on and off in response to the gamma selection signals gss. That is, as the two switches SW1 and SW2 are turned on or off, the levels of the gamma voltages GV1 to GV9 output from the second resistor string R-ST2 vary.

The gamma selection unit 153 has a plurality of gamma selectors GS1 to GS9. Each of the gamma selectors GS1 to GS9 selects and outputs one of the gamma voltages GV1 to GV9 output from the second resistor string R-ST2 in response to the corresponding one of the gamma selection signals gss. The first to ninth gamma selectors GS1 to GS9 select the gamma voltages GV1 to GV9 output from the second resistor string R-ST2 in decreasing order of voltages. For example, the second gamma selector GS2 selects and outputs gamma voltage GV2 among gamma voltages that are output from the second resistor string R-ST2, which is less than the gamma voltage GV1 selected by the first gamma selector GS1. Similarly, the third gamma selector GS3 selects and outputs gamma voltage GV3, which is less than gamma voltage GV2 selected by the second gamma selector GS2, and the ninth gamma selector GS9 selects and outputs gamma voltage GV9, which is less than the gamma voltage GV8 selected by the eighth gamma selector GS8. Thus, the gamma voltages GV1 to GV9 output from the first to ninth gamma selectors GS1 to GS9 decrease in sequence. Although the gamma selection unit 153 has the nine gamma selectors GS1 to GS9 in FIG. 1, the number of gamma selectors may vary. The gamma voltages GV1 to GV9 output from the gamma selection unit 153 are matched to points in the gamma characteristic curve of a display panel and output. In particular, most of the gamma voltages GV1 to GV9 are matched to points adjacent to an inflection point at which the gamma characteristic curve significantly varies. As the number of gamma selectors that the gamma selection unit 153 has increases, the number of gamma voltages output from the gamma selection unit 153 also increases, and thus the gamma voltages approximate the gamma characteristic curve. The gamma selectors GS1 to GS9 may be implemented as MUXs or decoders, like the maximum and minimum reference voltage selectors 121 and 122. However, as the number of gamma selectors increases, the grayscale voltage selector 150 remarkably increases in size. Thus, the number of gamma selectors must be appropriately adjusted during design.

The gamma buffer unit 154 has a plurality of gamma selection buffers GSB1 to GSB9. The gamma selection buffers GSB1 to GSB9, numbered the same as the gamma selectors GS1 to GS9, receive the gamma voltages GV1 to GV9 from the respective corresponding gamma selectors GS1 to GS9, and buffer and output the gamma voltages GV1 to GV9. In other words, each of the gamma selection buffers GSB1 to GSB9 corresponds to one of the gamma selectors GS1 to GS9, receives, buffers and outputs a gamma voltage output from the corresponding gamma selector. The gamma selection buffer GSB1 buffers the gamma voltage GV1 output from the gamma selector GS1 and outputs the sixty-third positive grayscale voltage VP62 and the second negative grayscale voltage VN1, and the gamma selection buffer GSB9 buffers the gamma voltage GV9 output from the gamma selector GS9 and outputs the second positive grayscale voltage VP1 and the sixty-third negative grayscale voltage VN62. Here, the second and sixty-third positive grayscale voltages VP1 and VP62 and the second and sixty-third negative grayscale voltages VN1 and VN62 are output because it is assumed that the display driver circuit 100 outputs sixty-four grayscale voltages. When the number of output grayscale voltages is n (where n is a natural number larger than 2), the first gamma selection buffer GSB1 may output an (n−1)th positive grayscale voltage VPn−2 and the second negative grayscale voltage VN1, and the ninth gamma selection buffer GSB9 may output the second positive grayscale voltage VP1 and an (n−1)th negative grayscale voltage VNn−2.

The positive resistor string PR-ST and the negative resistor string NR-ST are symmetrical to each other. In the negative resistor string NR-ST, resistors of the positive resistor string PR-ST are disposed in the reverse order. To be specific, each of the positive resistor string PR-ST and the negative resistor string NR-ST has a plurality of resistors PR1 to PRk or NR1 to NRk, and two resistors of the same number in the positive resistor string PR-ST and the negative resistor string NR-ST have the same resistance.

The positive resistor string PR-ST and the negative resistor string NR-ST respectively receives the sixty-fourth positive grayscale voltage VP63 and the first negative grayscale voltage VN0 from the first polarity selector 151 at one end, and the first positive grayscale voltage VP0 and the sixty-fourth negative grayscale voltage VN63 from the second polarity selector 152 at the other end. Each of the positive resistor string PR-ST and the negative resistor string NR-ST has the resistors PR1 to PRk or NR1 to NRk connected in series and outputs the positive grayscale voltages VP1 to VP62 or the negative grayscale voltages VN1 to VN62. Here, the sixty-fourth positive grayscale voltage VP63 and the first negative grayscale voltage VN0 applied from the first polarity selector 151 actually are equal to the maximum gamma voltage GVmax but are only classified according to whether the maximum gamma voltage GVmax is applied to the positive resistor string PR-ST or the negative resistor string NR-ST. Likewise, the first positive grayscale voltage VP0 and the sixty-fourth negative grayscale voltage VN63 applied from the second polarity selector 152 actually are equal to the minimum gamma voltage GVmin but are only classified according to whether the minimum gamma voltage GVmin is applied to the positive resistor string PR-ST or the negative resistor string NR-ST.

In other words, the first and second polarity selectors 151 and 152 select one of the positive resistor string PR-ST and the negative resistor string NR-ST and apply the maximum and minimum gamma voltages GVmax and GVmin to both ends of the selected resistor string. Thus, only the maximum and minimum gamma voltages GVmax and GVmin are applied to the first and second polarity selectors 151 and 152 regardless of the polarity selection signal pss. That is, the input signals of the first and second polarity selectors 151 and 152 do not swing according to the polarity selection signal pss.

The gamma selection buffers GSB1 to GSB9 buffer the corresponding gamma voltages GV1 to GV9, select one of the positive resistor string PR-ST and the negative resistor string NR-ST in response to the polarity selection signal pss, and apply the buffered gamma voltages GV1 to GV9 to the corresponding nodes among a plurality of nodes between a plurality of resistors of the selected resistor string.

The positive grayscale voltages VP0 to VP63 are output through a plurality of nodes of the positive resistor string PR-ST, and the negative grayscale voltages VN0 to VN63 are output through a plurality of nodes of the negative resistor string NR-ST. Nodes in the positive resistor string PR-ST and the negative resistor string NR-ST to which the gamma voltages GV1 to GV9 are applied are fixed by the gamma characteristic curve of the positive and negative grayscale voltages VP0 to VP63 and VN0 to VN63 to be output. Since the voltages of the nodes in the positive resistor string PR-ST and the negative resistor string NR-ST to which the gamma voltages GV1 to GV9 are applied are fixed by the gamma voltages GV1 to GV9, a voltage is divided by at least one resistor and applied to a node between the nodes in the positive resistor string PR-ST and the negative resistor string NR-ST to which the gamma voltages GV1 to GV9 are applied.

As illustrated in FIG. 1, when the fifth gamma selection buffer GSB5 disposed in the middle of the first to ninth gamma selection buffers GSB1 to GSB9 outputs a medium positive grayscale voltage VPC that is between the first positive grayscale voltage VP0 and the sixty-fourth positive grayscale voltage VP63, the fifth gamma selection buffer GSB5 may output a medium negative grayscale voltage VNC that is between the first negative grayscale voltage VN0 and the sixty-fourth negative grayscale voltage VN63 because the positive resistor string PR-ST and the negative resistor string NR-ST are symmetrical to each other. Also, the gamma selection buffers GSB1 to GSB9 may indicate positions that do not correspond to each other in the positive and negative resistor strings PR-ST and NR-ST. For example, even if the first gamma selection buffer GSB1 outputs the sixty-third positive grayscale voltage VP62, the first gamma selection buffer GSB1 may not output the second negative grayscale voltage VN1 corresponding to the sixty-third positive grayscale voltage VP62 but may output the third negative grayscale voltage VN2. In other words, positive and negative grayscale voltages output by each of the gamma selection buffers GSB1 to GSB9 may be adjusted according to the gamma characteristic curve of the display panel.

Here, either of the resistors of the positive resistor string PR-ST or the resistors of the negative resistor string NR-ST may not have the same resistance in consideration of the gamma characteristic curve. However, when the resistors of the positive resistor string PR-ST have the same resistance, the negative resistor string NR-ST may be configured to be the same as the positive resistor string PR-ST. The positive and negative resistor strings PR-ST and NR-ST may be classified as a resistor string unit and disposed out of the gamma voltage selector 150.

The grayscale voltage selector 155 selects one of the positive grayscale voltages VP0 to VP63 applied from the positive resistor string PR-ST or the negative grayscale voltages VN0 to VN63 applied from the negative resistor string NR-ST in response to the polarity selection signal pss, and outputs a selection grayscale voltage GSV. In other words, the grayscale voltage selector 155 may output one of symmetrical grayscale voltages VP0 to VP63 or VN0 to VN63 in response to the polarity selection signal pss.

Thus, the above-described display driver circuit 100 of FIG. 1 may output the positive grayscale voltages VP0 to VP63 and the negative grayscale voltages VN0 to VN63 corresponding to the positive grayscale voltages VP0 to VP63 in response to the polarity signal PS. Also, even if the display driver circuit 100 alternately outputs the positive and negative grayscale voltages VP0 to VP63 and VN0 to VN63, the gamma voltages GVmax, GVmin, and GV1 to GV9 do not vary, and thus the first and second reference buffers 123 and 124, the first and second polarity selectors 151 and 152, and first to ninth gamma selection buffers GSB1 to GSB9 do not swing output or input signals. Consequently, a delay in outputting the symmetrical grayscale voltages VP0 to VP63 and VN0 to VN63 is very short, and it is possible to generate the symmetrical grayscale voltages VP0 to VP63 and VN0 to VN63 at high speed.

Although not shown, the display driver circuit 100 of FIG. 1 may additionally include a common voltage generator for generating a common voltage applied to a common electrode (not shown). A display driver circuit using the method of inverting the polarity of a pixel electrode may have to apply the positive and negative grayscale voltages VP0 to VP63 and VN0 to VN63 to a pixel electrode and also a first common voltage corresponding to the positive grayscale voltages VP0 to VP63 and a second common voltage corresponding to the negative grayscale voltages VN0 to VN63 to the common electrode. In this case, the common voltage generator (not shown) may generate the first and second common voltages in response to the polarity selection signal pss.

Figure 2:
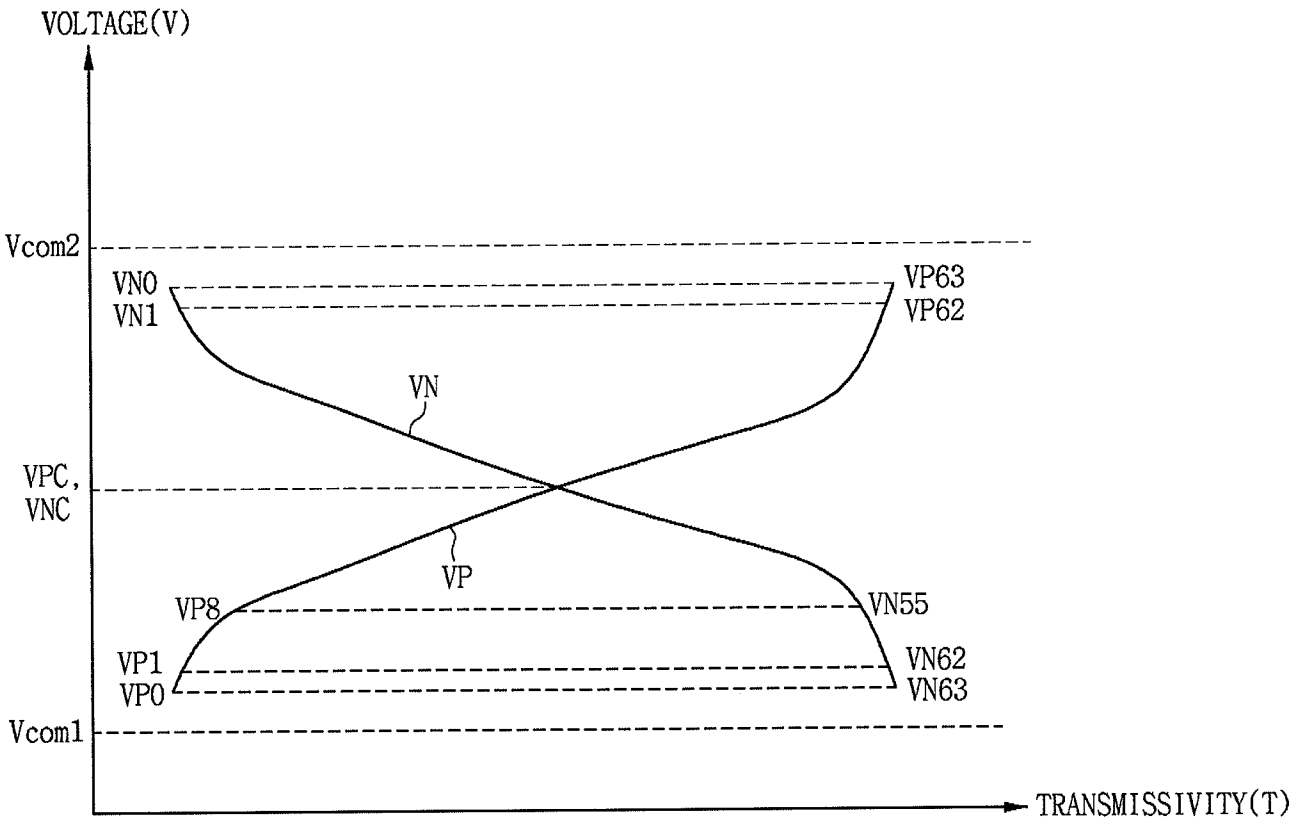
FIG. 2 is a graph illustrating symmetrical grayscale voltages generated from the display driver circuit of FIG. 1.

FIG. 2 is a grayscale voltage (V)-transmissivity (T) graph showing the relationship between grayscale voltage and transmissivity to describe symmetrical grayscale voltages generated from the display driver circuit of FIG. 1.

Symmetrical grayscale voltages of FIG. 2 will now be described with reference to FIG. 1. As illustrated in FIG. 2, the positive grayscale voltages VP0 to VP63 in a positive grayscale voltage characteristic curve VP increase as transmissivity increases, while the negative grayscale voltages VN0 to VN63 in a negative grayscale voltage characteristic curve VN decrease as transmissivity increases. The first positive grayscale voltage VP0 and the sixty-fourth negative grayscale voltage VN63 are the same as the minimum gamma voltage GVmin, and the first negative grayscale voltage VN0 and the sixty-fourth positive grayscale voltage VP63 are the same as the maximum gamma voltage GVmax. Also, the medium positive grayscale voltage VPC and the medium negative grayscale voltage VNC are the same. The positive and negative grayscale voltage characteristic curves VP and VN are symmetrical with respect to the medium positive grayscale voltage VPC and the medium negative grayscale voltage VNC.

A first common voltage Vcom1 is lower than the first positive grayscale voltage VP0 and the sixty-fourth negative grayscale voltage VN63 by a predetermined amount (e.g., 0.3 V), and a second common voltage Vcom2 is higher than the first negative grayscale voltage VN0 and the sixty-fourth positive grayscale voltage VP63 by a predetermined amount (e.g., 0.3 V). A difference between the first common voltage Vcom1 and the first positive grayscale voltage VP0 may be set to be the same as a difference between the second common voltage Vcom2 and the first negative grayscale voltage VN0. In other words, differences between the first or second common voltage Vcom1 or Vcom2 applied to the common electrode and the positive or negative grayscale voltages VP0 to VP63 or VN0 to VN63 applied to a pixel electrode have the same absolute value and opposite polarities, so that electric fields are applied between the common electrode and the pixel electrode in opposite directions. However, since the voltage differences have the same absolute value, the same electric fields are applied to a liquid crystal layer, and the liquid crystal layer has the same transmissivity.

Figure 3:
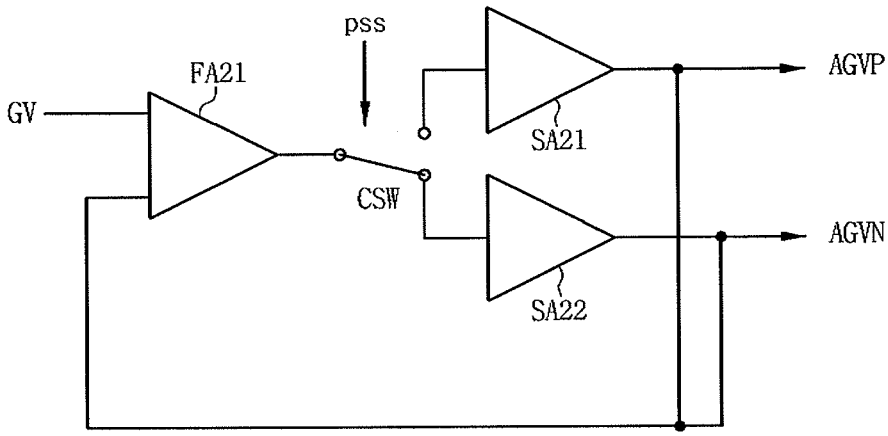
FIG. 3 is a circuit diagram of an exemplary gamma selection buffer shown in FIG. 1.

FIG. 3 is a circuit diagram of an example of a gamma selection buffer shown in FIG. 1.

Each of the gamma selection buffers GSB1 to GSB9 may include a first amplifier FA21, second amplifiers SA21 to SA22, and a switch CSW.

In the exemplary gamma selection buffer shown in FIG. 3, the switch CSW performs a switching operation in response to the polarity selection signal pss so that the first amplifier FA21 is connected with one of the second amplifiers SA21 and SA22. Each of the second amplifiers SA21 and SA22 is connected with the corresponding one of a plurality of nodes in the positive resistor string PR-ST or the negative resistor string NR-ST. The first amplifier FA21 amplifies a difference between a gamma voltage GV output from the corresponding one of the gamma selectors GS1 to GS9 in the gamma selection unit 153 and an output VP or VN fed back from a selected one of the second amplifiers SA21 and SA22, and outputs the amplified difference to the selected one of the second amplifiers SA21 and SA22. One of the second amplifiers SA21 and SA22 selected by the switch CSW buffers the output of the first amplifier FA21 and outputs the buffered grayscale voltage VP or VN to the corresponding node in the positive resistor string PR-ST or the negative resistor string NR-ST. For example, when the switch CSW selects the second amplifier SA21 in response to the polarity selection signal pss, the first amplifier FA21 amplifies a difference between the positive grayscale voltage VP output from the second amplifier SA21 and the gamma voltage GV applied from the corresponding gamma selector, and outputs the amplified voltage difference to the selected second amplifier SA21. Then, the selected second amplifier SA21 buffers the voltage applied from the first amplifier FA21 and outputs the buffered voltage to the corresponding node in the connected positive resistor string PR-ST.

Figure 4:
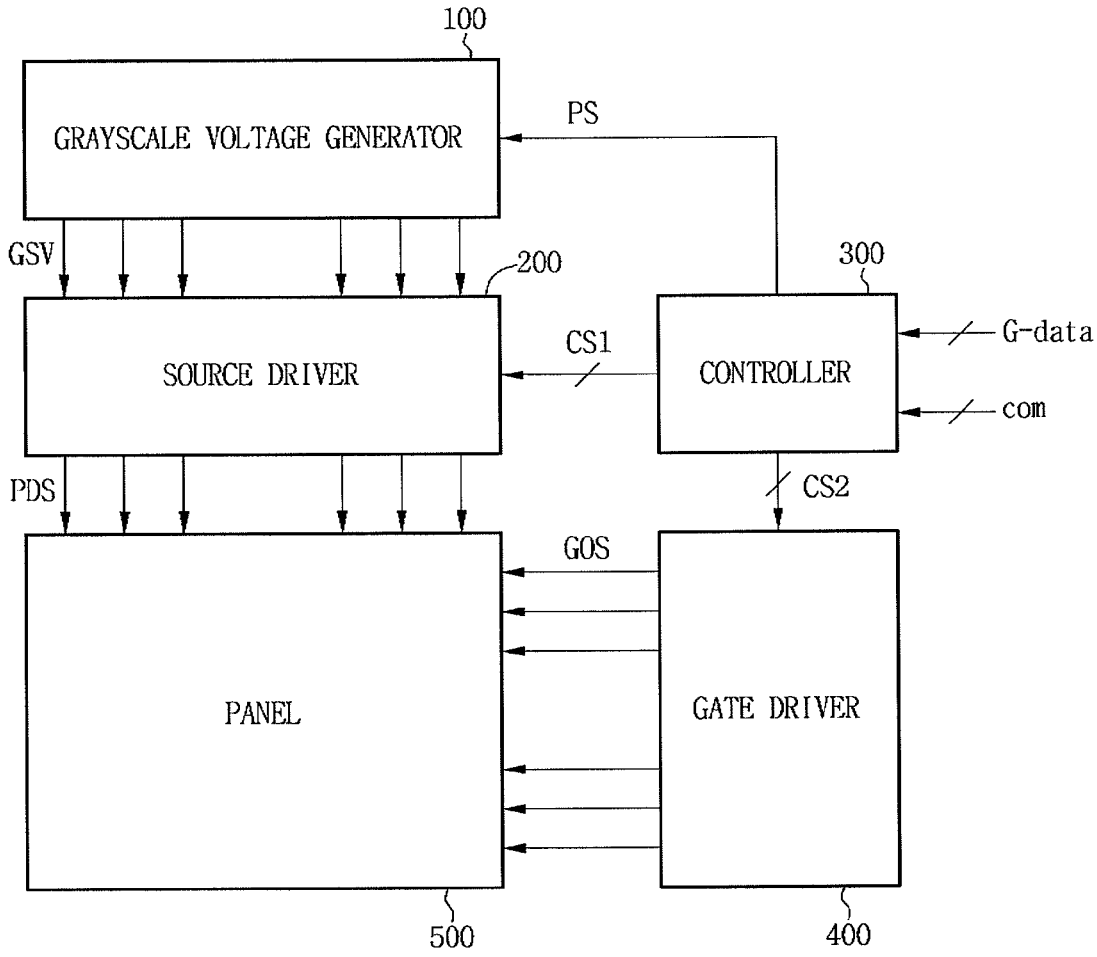
FIG. 4 is a block diagram of a display device according to an example embodiment.

FIG. 4 is a block diagram of a display device according to an exemplary embodiment.

Referring to FIG. 4, the display device includes a grayscale voltage generator 100, a source driver 200, a controller 300, and a gate driver 400, and a panel 500.

The grayscale voltage generator 100 generates positive grayscale voltages VP0 to VP63 or negative grayscale voltages VN0 to VN63 in response to a polarity signal PS applied from the controller 300, and provides one of the generated positive grayscale voltages VP0 to VP63 or negative grayscale voltages VN0 to VN63 to the source driver 200 as a selection grayscale voltage GSV. The source driver 200 receives the selection grayscale voltage GSV in response to a source driver control signal CS1 applied from the controller 300, and applies a display data voltage PDS to the data lines of the panel 500. The gate driver 400 applies a gate-on voltage GOS to the gate lines of the panel 500 in response to a gate driver control signal CS2 applied from the controller 300, thereby driving the display panel 500. The controller 300 provides the source driver control signal CS1 to the source driver 200 and the gate driver control signal CS2 to the gate driver 400 in response to image data G-data and a command com applied from the outside, thereby controlling the gate driver 400 and the source driver 200. Also, the controller 300 applies the polarity signal PS to the grayscale voltage generator 100 according to the method of inverting the polarity of a pixel electrode so that one of the positive grayscale voltages VP0 to VP63 or the negative grayscale voltages VN0 to VN63 is output to the source driver 200 as the selection grayscale voltage GSV.

As described above, in a display driver circuit according to one or more exemplary embodiments, a grayscale voltage generator may have symmetrically formed positive and negative resistor strings, and may apply the maximum and minimum gamma voltages to one of the positive and negative resistor strings in response to a polarity selection signal, thereby generating a plurality of positive grayscale voltages or a plurality of negative grayscale voltages without changing the gamma voltages. Even if the polarity of a grayscale voltage is changed, the grayscale voltage generator does not change a gamma voltage and thus can generate symmetrical grayscale voltages at high speed and low power consumption.

The foregoing is illustrative of exemplary embodiments and is not to be construed as limiting thereof. Although a few exemplary embodiments have been described, those skilled in the art will readily appreciate that many modifications are possible in the exemplary embodiments without materially departing from the novel teachings and aspects. Accordingly, all such modifications are intended to be included within the scope of this inventive concept as defined in the claims. For example, exemplary embodiments can be applied to a measurement method for monitoring process variation in semiconductor equipment. In the claims, means-plus-function clauses are intended to cover the structures described herein as performing the recited function, and not only structural equivalents but also equivalent structures. Therefore, it is to be understood that the foregoing is illustrative of various exemplary embodiments and is not to be construed as limited to the specific embodiments disclosed, and that modifications to the disclosed embodiments, as well as other embodiments, are intended to be included within the scope of the appended claims.

What is claimed is:

1. A display driver circuit, comprising:

a reference voltage selection unit configured to receive and divide a first supply voltage and a second supply voltage, and select and output a maximum reference voltage and a minimum reference voltage; and a grayscale voltage generator including a gamma voltage selector configured to receive the maximum and minimum reference voltages, generate at least two gamma voltages by dividing the maximum and minimum reference voltages, and generate, using the at least two gamma voltages, at least two positive grayscale voltages that range from the minimum reference voltage to the maximum reference voltage or at least two negative grayscale voltages that range from the maximum reference voltage to the minimum reference voltage, wherein an absolute value of a difference between a first positive grayscale voltage and a second positive grayscale voltage of the at least two positive grayscale voltages equals an absolute value of a difference between a first negative grayscale voltage and a second negative grayscale voltage of the at least two negative grayscale voltages; and wherein the grayscale voltage generator comprises at least two gamma selection buffers, each gamma selection buffer including:

a first amplifier configured to receive a corresponding one of the at least two gamma voltages and a feedback voltage, sense and amplify a difference between the corresponding one of the at least two gamma voltages and the feedback voltage, and output the amplified difference;

two second amplifiers configured to receive and buffer the output of the first amplifier, output a corresponding grayscale voltage to corresponding nodes of a positive resistor string and a negative resistor string of the gamma voltage selector, and apply the corresponding grayscale voltage to the first amplifier as the feedback voltage; and a switch configured to transfer the output of the first amplifier to one of the two second amplifiers in response to a polarity selection signal.

2. The display driver circuit according to claim 1, wherein the reference voltage selection unit includes:

a first resistor string including a plurality of first resistors connected in series between the first and second supply voltages and configured to divide the first and second supply voltages;

a maximum reference voltage selector configured to select a first voltage divided by the first resistor string in response to a maximum reference voltage selection signal, and output the first voltage as the maximum reference voltage;

a minimum reference voltage selector configured to select a second voltage divided by the first resistor string that is lower than the maximum reference voltage in response to a minimum reference voltage selection signal, and output the second voltage as the minimum reference voltage;

a first reference buffer configured to receive and buffer the maximum reference voltage and output a maximum gamma voltage from among the at least two gamma voltages; and a second reference buffer configured to receive and buffer the minimum reference voltage and output a minimum gamma voltage from among the at least two gamma voltages.

3. The display driver circuit according to claim 2, wherein the gamma voltage selector includes:

a gamma voltage generator configured to receive the maximum and minimum gamma voltages and generate the at least two gamma voltages by dividing the maximum and minimum gamma voltages in response to one or more gamma selection signals;

a resistor selector configured to apply the at least two gamma voltages to corresponding nodes among a plurality of nodes of a resistor string selected from the positive resistor string and the negative resistor string in response to the polarity selection signal;

a resistor string unit including the positive resistor string and the negative resistor string that receive the at least two gamma voltages at corresponding nodes, and respectively generate the at least two positive grayscale voltages having sequentially increasing levels and the at least two negative grayscale voltages having sequentially decreasing levels by dividing the at least two gamma voltages; and a grayscale voltage selector configured to receive the at least two positive grayscale voltages and the at least two negative grayscale voltages from the resistor string selected from the positive resistor string and the negative resistor string in response to the polarity selection signal, and output a selection grayscale voltage.

4. The display driver circuit according to claim 3, wherein the gamma voltage generator includes:

a second resistor string including a plurality of second resistors connected in series between the maximum and minimum gamma voltages and configured to divide the maximum and minimum gamma voltages; and a gamma selection unit configured to select at least one gamma voltage divided by the second resistor string in response to the one or more gamma selection signals and output the at least one selected gamma voltage.

5. The display driver circuit according to claim 4, wherein the gamma selection unit includes at least one gamma selector configured to select one of voltages divided by the second resistor string in response to a corresponding gamma selection signal of the at least one gamma selection signal.

6. The display driver circuit according to claim 3, wherein the positive resistor string includes a plurality of third resistors connected in series, and is configured to receive the at least two gamma voltages and generate the at least two positive grayscale voltages by dividing the at least two gamma voltages.

7. The display driver circuit according to claim 6, wherein the negative resistor string includes a plurality of fourth resistors having the same resistance as the plurality of third resistors, connected in series, and disposed in the reverse order of the third resistors, and is configured to receive the at least two gamma voltages and generate the at least two negative grayscale voltages by dividing the at least two gamma voltages.

8. The display driver circuit according to claim 3, wherein the resistor selector includes:

a first polarity selector configured to apply the maximum gamma voltage to a first end of the resistor string selected from the positive resistor string and the negative resistor string in response to the polarity selection signal;

a second polarity selector configured to apply the minimum gamma voltage to a second end of the resistor string selected from the positive resistor string and the negative resistor string in response to the polarity selection signal; and a gamma selection buffer unit configured to receive at least two gamma voltages and output the at least two gamma voltages to corresponding nodes of the resistor string selected from the positive resistor string and the negative resistor string in response to the polarity selection signal.

9. The display driver circuit according to claim 8, wherein the gamma selection buffer unit includes the at least two gamma selection buffers.

10. The display driver circuit according to claim 3, wherein the grayscale voltage generator further includes a common voltage generator configured to generate and output at least one of a first common voltage that is lower than the minimum gamma voltage and a second common voltage that is higher than the maximum gamma voltage in response to the polarity selection signal.

11. The display driver circuit according to claim 10, wherein the grayscale voltage generator further includes:

a reference voltage selection register configured to output the maximum and minimum reference voltage selection signals;

a gamma selection register configured to output the one or more gamma selection signals; and a polarity selection register configured to output the polarity selection signal in response to a polarity signal.

12. The display driver circuit according to claim 11, further comprising:

a controller configured to output a source driver control signal, a gate driver control signal, and the polarity signal in response to image data and a command;

a source driver configured to receive the selection grayscale voltage in response to the source driver control signal, and apply a display data voltage to data lines of a display panel; and a gate driver configured to apply a gate-on voltage to gate lines of the display panel in response to the gate driver control signal.

13. A display device comprising:

a panel including an array substrate including a plurality of pixel electrodes between a plurality of data lines and a plurality of gate lines, a counter substrate disposed to face the array substrate and including at least one common electrode, and a liquid crystal layer interposed between the array substrate and the counter substrate;

a controller configured to output a source driver control signal, a gate driver control signal, and a polarity signal in response to image data and a command;

a grayscale voltage generator configured to output a selection grayscale voltage in response to the polarity signal;

a source driver configured to receive the selection grayscale voltage in response to the source driver control signal and apply a display data voltage to the plurality of data lines; and a gate driver configured to apply a gate-on voltage to the plurality of gate lines in response to the gate driver control signal, wherein the grayscale voltage generator includes:

a reference voltage selection unit configured to receive and divide a first supply voltage and a second supply voltage, and select and output a maximum reference voltage and a minimum reference voltage; and a gamma voltage selector configured to receive the maximum and minimum reference voltages, generate at least two gamma voltages by dividing the maximum and minimum reference voltages, and generate at least two positive grayscale voltages that range from the minimum reference voltage to the maximum reference voltage or at least two negative grayscale voltages that range from the maximum reference voltage to the minimum reference voltage using the at least two gamma voltages, wherein an absolute value of a difference between a first positive grayscale voltage and a second positive grayscale voltage of the at least two positive grayscale voltages equals an absolute value of a difference between a first negative grayscale voltage and a second negative grayscale voltage of the at least two negative grayscale voltages; and wherein the grayscale voltage generator comprises at least two gamma selection buffers, each gamma selection buffer including:

a first amplifier configured to receive a corresponding one of the at least two gamma voltages and a feedback voltage, sense and amplify a difference between the corresponding one of the at least two gamma voltages and the feedback voltage, and output the amplified difference;

two second amplifiers configured to receive and buffer the output of the first amplifier, output a corresponding grayscale voltage to corresponding nodes of a positive resistor string and a negative resistor string of the gamma voltage selector, and apply the corresponding grayscale voltage to the first amplifier as the feedback voltage; and a switch configured to transfer the output of the first amplifier to one of the two second amplifiers in response to a polarity selection signal.

14. The display device according to claim 13, wherein the reference voltage selection unit includes:

a first resistor string including a plurality of first resistors connected in series between the first and second supply voltages and configured to divide the first and second supply voltages;

a maximum reference voltage selector configured to select a first voltage divided by the first resistor string in response to a maximum reference voltage selection signal, and output the first voltage as the maximum reference voltage;

a minimum reference voltage selector configured to select a second voltage divided by the first resistor string that is lower than the maximum reference voltage in response to a minimum reference voltage selection signal, and output the second voltage as the minimum reference voltage;

a first reference buffer configured to receive and buffer the maximum reference voltage and output a maximum gamma from among the at least two gamma voltages; and a second reference buffer configured to receive and buffer the minimum reference voltage and output a minimum gamma voltage from among the at least two gamma voltages.

15. The display device according to claim 14, wherein the gamma voltage selector includes:

a gamma voltage generator configured to receive the maximum and minimum gamma voltages and generate the at least two gamma voltages by dividing the maximum and minimum gamma voltages in response to one or more gamma selection signals;

a resistor selector configured to apply the at least two gamma voltages to corresponding nodes among a plurality of nodes of a resistor string selected from the positive resistor string and the negative resistor string in response to the polarity selection signal;

a resistor string unit including the positive resistor string and the negative resistor string that receive the at least two gamma voltages at corresponding nodes, and respectively generate the at least two positive grayscale voltages having sequentially increasing levels and the at least two negative grayscale voltages having sequentially decreasing levels by dividing the at least two gamma voltages; and a grayscale voltage selector configured to receive the at least two positive grayscale voltages and the at least two negative grayscale voltages from the resistor string selected from the positive resistor string and the negative resistor string in response to the polarity selection signal, and output the selection grayscale voltage.

16. The display panel according to claim 15, wherein the gamma voltage generator includes:

a second resistor string having a plurality of second resistors connected in series between the maximum and minimum gamma voltages and configured to divide the maximum and minimum gamma voltages; and a gamma selection unit configured to select at least one gamma voltage divided by the second resistor string in response to the one or more gamma selection signals and output the at least one selected gamma voltage.

17. The display device according to claim 15, wherein the positive resistor string includes a plurality of third resistors connected in series, and is configured to receive the at least two gamma voltages and generate the at least two positive grayscale voltages by dividing the at least two gamma voltages.

18. The display device according to claim 17, wherein the negative resistor string includes a plurality of fourth resistors having the same resistance as the plurality of third resistors, connected in series, and disposed in the reverse order of the third resistors, and is configured to receive the at least two gamma voltages and generate the at least two negative grayscale voltages by dividing the at least two gamma voltages.

19. The display device according to claim 15, wherein the resistor selector includes:

a first polarity selector configured to apply the maximum gamma voltage to a first end of the resistor string selected from the positive resistor string and the negative resistor string in response to the polarity selection signal;

a second polarity selector configured to apply the minimum gamma voltage to a second end of the resistor string selected from the positive resistor string and the negative resistor string in response to the polarity selection signal; and a gamma selection buffer unit configured to receive at least two gamma voltages and output the at least two gamma voltages to corresponding nodes of the resistor string selected from the positive resistor string and the negative resistor string in response to the polarity selection signal.

* * * * *